US005535648A

United States Patent [19]

Braun et al.

[11] Patent Number: 5,535,648

[45] Date of Patent: Jul. 16, 1996

[54] RATCHETING SCREWDRIVER

[75] Inventors: John A. Braun, Kenilworth; Frank Occidentale, Elmwood Park, both of N.J.

[73] Assignee: Snap-on Technologies, Inc., Crystal Lake, Ill.

[21] Appl. No.: 394,490

[22] Filed: Feb. 27, 1995

[51] Int. Cl.[6] ..... B25B 15/04

[52] U.S. Cl. ..... 81/63.1; 81/60

[58] Field of Search ..... 81/60, 58.3, 62, 81/63.1, 438, 439, 32

[56] References Cited

U.S. PATENT DOCUMENTS

| | | | |
|---|---|---|---|
| Re. 34,680 | 8/1994 | Lieser . | |
| 1,265,341 | 5/1918 | Keller . | |
| 1,878,053 | 9/1932 | Winger . | |
| 2,629,415 | 2/1953 | Baker | 81/58.3 |
| 2,982,161 | 5/1961 | Angquist et al. | 81/60 |
| 2,986,248 | 5/1961 | Rock . | |
| 2,997,148 | 8/1961 | Linsley . | |
| 3,477,486 | 11/1969 | Modrey . | |
| 3,554,251 | 1/1971 | McLogan . | |
| 3,621,739 | 11/1971 | Seablom . | |
| 3,819,194 | 6/1974 | Grevich et al. . | |
| 3,823,625 | 7/1974 | Myers . | |
| 3,908,487 | 9/1975 | Plaw . | |
| 3,967,831 | 7/1976 | Chang et al. . | |
| 4,466,523 | 8/1984 | De Carolis et al. . | |
| 4,777,852 | 10/1988 | Herman et al. | 81/63.1 |
| 4,799,407 | 1/1989 | Miyamoto . | |
| 5,069,091 | 12/1991 | Bramsiepe et al. | 81/60 |
| 5,152,197 | 10/1992 | Szymber et al. . | |

*Primary Examiner*—Willis Little
*Attorney, Agent, or Firm*—Emrich & Dithmar

[57] ABSTRACT

A ratcheting screwdriver is operable in reverse ratcheting, forward ratcheting and locked non-ratcheting modes. The screwdriver includes a rotatable handle having along an end thereof a substantially cylindrical interior wall defining an annular base surface and an axial bore. The base surface includes two substantially arcuate grooves formed therein which communicate with the bore. An insert is received in the bore and includes longitudinally extending teeth equi-angularly spaced around the outer periphery thereof. First and second balls are respectively positioned in the arcuate grooves and urged against the insert by first and second compression springs, respectively. In the locked mode, the first and second balls are wedged against teeth on the insert to prevent ratcheting of the handle relative to a bit regardless of direction of handle rotation. In each of reverse and forward ratcheting modes, a corresponding one of the balls is urged away from its wedged engagement with the teeth on the insert, to provide ratcheting of the bit in the associated direction of handle rotation, and rotation of the bit together with the handle in the opposite direction. In a second related embodiment, a left-right pawl/torsion spring assembly is used in place of the ball/compression spring assembly.

19 Claims, 4 Drawing Sheets

RATCHETING SCREWDRIVER

BACKGROUND OF THE INVENTION

1. Field of the Invention

The present invention relates to an improved ratcheting mechanism adapted for use with a screwdriver and, more particularly, to a ratcheting screwdriver which provides three modes of operation, including ratcheting modes in forward and reverse directions and a non-ratcheting mode.

2. Description of the Prior Art

There are a number of prior art disclosures directed to the use of ratchet mechanisms in conjunction with hand tools—particularly wrenches which employ a handle mechanism substantially perpendicular to the axis of rotation of the tool. The use of a ratchet mechanism in conjunction with screwdrivers entails design constraints in terms of compactness of the ratchet mechanism. Such constraints are made all the more difficult when the tool is a miniature screwdriver of the type most appropriately used to tighten and loosen the very smallest type screws, as well as hard to reach screws, such as screws used on dental prosthodontic devices and the like.

U.S. Pat. No. 4,466,523 to De Carolis et al. generally discloses a ratchet handle for a miniature screwdriver which employs a pair of opposing pawls which are biased by a spring and which selectively engage teeth at the interior of a cylindrical structure to provide a three-mode ratchet drive. A shifter engageable at one of three positions has so-called ears which selectively interact With the pawls. In one embodiment, three pairs of opposing pawls are biased by a garter spring. In a second embodiment, an integral serpentine spring/pawl assembly is employed to provide ratcheting in the selected direction mode. Both constructions involve the use of components whose geometry is very complex. As a result the cost of manufacturing miniature screwdrivers of this type is high and manufacture is difficult.

SUMMARY OF THE INVENTION

It is a general object of the present invention to provide a ratcheting screwdriver which is economical and easy to manufacture.

It is another object of the present invention to provide an improved ratcheting screwdriver having reverse and forward direction ratchet modes and a locked or non-ratcheting mode.

It is another object of the present invention to provide a ratcheting screwdriver which is of compact and sturdy construction, which requires only a minimum number of cooperating parts, and which is capable of transmitting extremely high turning forces without experiencing mechanical breakdown or slippage.

It is yet another object of the present invention to provide a screwdriver which is highly efficient, but includes a reversible ratchet mechanism of simple design, the mechanism allowing change in mode using only the fingers of the hand in which the tool is held.

In accordance with a first embodiment, these and other features of the invention are attained by providing a ratcheting screwdriver operable in reverse ratcheting, forward ratcheting and locked modes, which includes a rotatable handle having along an end thereof a substantially cylindrical interior wall defining an annular base surface and an axial bore. The base surface has two substantially arcuate grooves formed therein which communicate with the bore. An insert is received within the bore and includes longitudinally extending arcuate teeth spaced equiangularly around the outer periphery thereof. First and second balls are respectively positioned in the arcuate grooves and urged against the insert by first and second compression springs, respectively. A screwdriver bit is coupled to the insert for rotation therewith. A cap, coupled to the rotatable handle, includes a mode-shifting assembly for selecting the mode of operation of the screwdriver. In a locked mode, each of the first and second balls are wedged against teeth on the insert to prevent ratcheting of the handle relative to the bit regardless of direction of handle rotation. In each of reverse and forward ratcheting modes, a corresponding one of the balls is urged away from its wedged engagement with the teeth on the insert, to provide ratcheting of the bit in the associated direction of handle rotation, and rotation of the bit together with the handle in the opposite direction.

In accordance with a second preferred embodiment, a ratcheting screwdriver is provided operable in reverse ratcheting, forward ratcheting and locked modes, which includes a rotatable handle having at an end thereof a cylindrical wall defining an axial bore, the wall having left and right pawl receptacles formed therein and communicating with the bore. An insert is received in the bore and includes longitudinally-extending teeth equiangularly spaced around the outer periphery thereof. Left and right pawls are respectively positioned within the left and right receptacles and urged against the insert by corresponding left and right torsion springs, respectively. A screwdriver bit is coupled to the insert for rotation therewith. A cap, coupled to the rotatable handle, includes a mode-shifting assembly for selecting the mode of operation of the screwdriver. In a locked mode, each of the left and right pawls are wedged against teeth on the insert to prevent ratcheting of the handle relative to the bit regardless of direction of handle rotation. In each of the reverse and forward ratcheting modes, a corresponding one of the left and right pawls is urged away from its wedged engagement with the teeth on the insert, to provide ratcheting of the bit in the associated direction of handle rotation, and rotation of the bit together with the handle in the opposite direction.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
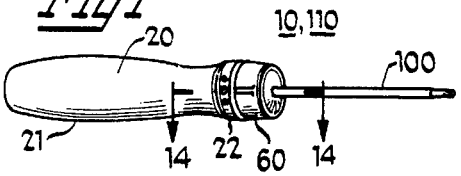
FIG. 1 is a perspective view of a ratcheting screwdriver constructed in accordance with and embodying the features of the present invention.
Figure 2:
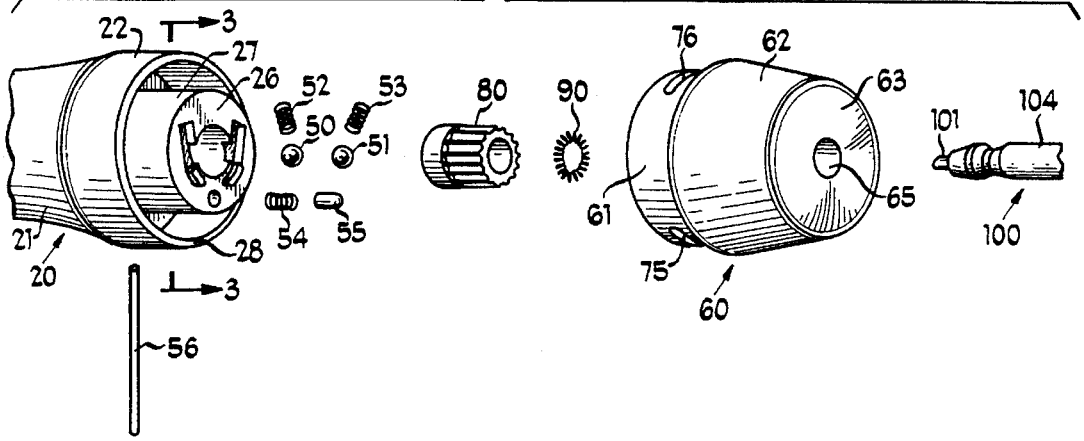
FIG. 2 is an exploded, perspective view of the ratcheting mechanism of the screwdriver of FIG. 1 with the rotatable handle and screwdriver bit shown in fragmentary view.
Figure 5:
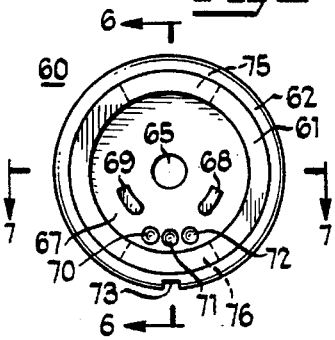
FIG. 5 is an enlarged, end elevational view of the cap shown in FIG. 2 as viewed from the left-hand end thereof.
Figure 6:
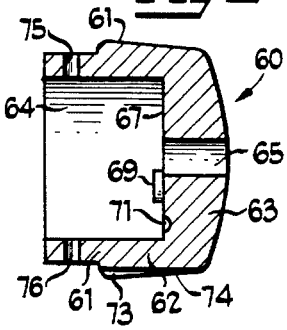
FIG. 6 is a vertical sectional view taken generally along the line 6—6 in FIG. 5.

Referring to FIGS. 1 and 2, there is illustrated a ratcheting screwdriver generally designated by the numeral 10 and including a rotatable handle 20, balls 50, 51, compression springs 52, 53, resilient spring 54, detent pin 55, dowel pin 56, direction shifting cap 60, scalloped insert 80, canted coil spring 90, and screwdriver bit 100, constructed in accordance with and embodying the features of the present invention.

Figure 3:
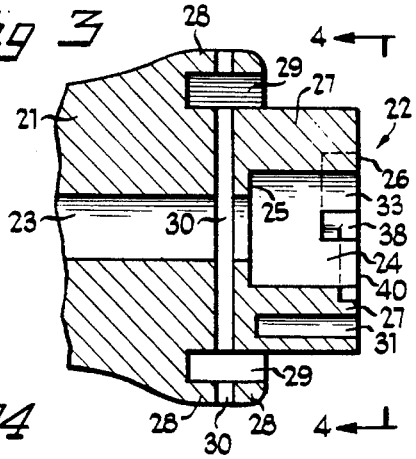
FIG. 3 is an enlarged, fragmentary, sectional view of the end of the rotatable handle constituting part of the ratcheting mechanism, taken along the line 3—3 in FIG. 2.
Figure 4:
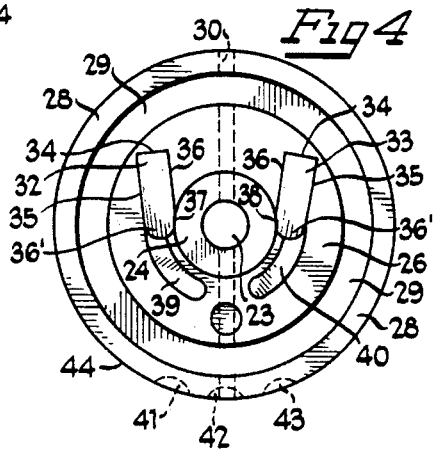
FIG. 4 is an end elevational view taken generally in the direction indicated by line 4—4 in FIG. 3.

Handle 20 consists of a handle portion 21 and a head portion 22. Referring to FIGS. 3 and 4, the head portion 22 is provided with an axial bore 23 with an enlarged counterbore 24 at its outer end. Bore 24 extends axially from an inner surface 25 to an outer end surface 26 of head portion 22 and defines a first cylindrical wall 27. A second concentric cylindrical wall 28 of greater inner diameter than the outer diameter of the first cylindrical wall 27 is spaced therefrom by a short annular cavity 29. A bore 30 extends diametrically through the head portion 22, intersecting the cavity 29 and the bore 23. A blind ended cylindrical bore 31 extends longitudinally a fixed distance from the end surface 26 into a section of first cylindrical wall 27 parallel to the axis of the bore 23.

Also on end surface 26 there are formed a first pair of grooves 32, 33 of fixed depth each defined by a short flat end wall 34 and substantially parallel longer side walls 35, 36. Opposite short flat end walls 34 are arcuate walls 36'. Arcuate walls 36' and side walls 36 intersect at counterbore 24 so that grooves 32, 33 communicate with counterbore 24 by way of slots 37, 38. A second pair of substantially arcuate-shaped grooves 39, 40 are provided having depth less than associated grooves 32, 33 and communicating therewith.

Reverse position indicating depression 41, locked position indicating depression 42, and forward position indicating depression 43 are provided on the outer surface 44 of second cylindrical wall 28. The function of these depressions will be explained below.

The direction shifting cap 60, shown in FIGS. 5–8 is intended for coupling to the head portion 22 of handle 20 in the manner to be described below. Cap 60 consists of a generally cylindrical wall 61 an upper end 62 of which is slightly thicker along an outer circumference thereof. The wall 61 is closed at one end by a base wall 63 to define a cavity 64 whose diameter is slightly greater than the outer diameter of first cylindrical wall 27 of head portion 22, the latter being rotatably fit within cavity 64 during screwdriver assembly. An axial bore 65 is formed through the base wall 63. Projecting inwardly from the inner surface 67 of base wall 63 are arcuate projections 68 and 69 having a width slightly less than the width of associated arcuate-shaped grooves 39, 40. Detent pin receiving circular grooves 70, 71, and 72 having fixed depth are also formed in the inner surface 67. A beveled recess 73 extends longitudinally on the outer surface 74 of wall 61 centered along a radius passing through circular groove 71. Arcuate slots 75, 76 are formed opposite each other through the wall 61 adjacent to the open end thereof and sized to permit dowel pin 56 (see FIG. 2) to fit therethrough.

Figure 9:
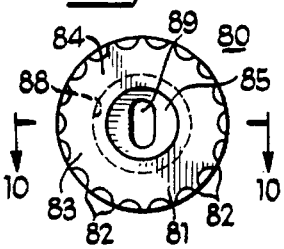
FIG. 9 is an enlarged, end elevational view of the right-hand end of the scalloped insert shown in FIG. 2.
Figure 10:
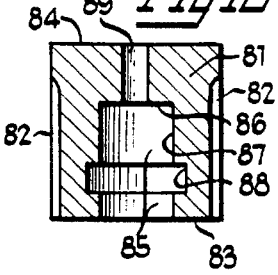
FIG. 10 is a sectional view taken generally along the line 10—10 in FIG. 9.
Figure 7:
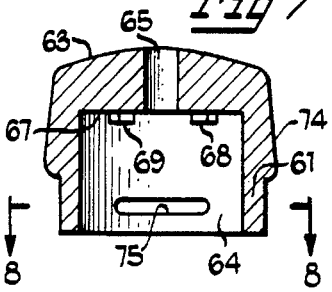
FIG. 7 is a horizontal sectional view taken generally along the line 7—7 in FIG. 5.
Figure 11:
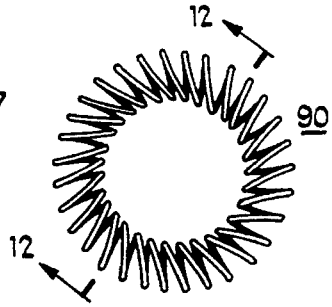
FIG. 11 is an enlarged plan view of the canted coil spring shown in FIG. 2.
Figure 12:
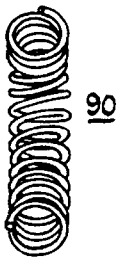
FIG. 12 is a sectional view taken generally along the line 12—12 in FIG. 11.

The scalloped insert 80, shown in FIGS. 9 and 10, consists of a cylindrical body 81 having, along the outer surface thereof, a plurality of equiangularly spaced, axially extending teeth 82. Each tooth extends axially from an end surface 83 to a fixed distance from an end surface 84. The outer diameter of cylindrical body 81 is slightly less than the inner diameter of the wall defined by counterbore 24 in head portion 22 and is sized to be received thereby. A cylindrical bore 85 extends axially a fixed distance from end surface 83 to a shoulder 86, and is defined by a cylindrical surface 87 in which is formed an annular groove 88 sized to receive the outer periphery of the canted coil spring 90 shown in FIGS. 11 and 12. An ellipsoidal bore 89 extends longitudinally from shoulder 86 to the end surface 84 of insert 80.

Figure 13:
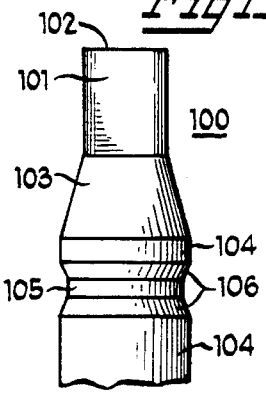
FIG. 13 is an enlarged, fragmentary, side elevational view of the screwdriver bit shown partially in FIG. 2.
Figure 8:
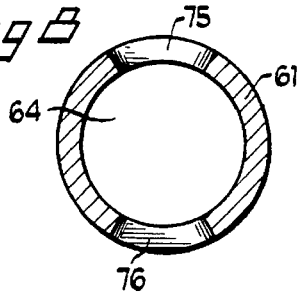
FIG. 8 is a sectional view taken generally along the line 8—8 in FIG. 7.

The screwdriver bit 100, shown in partial view in FIG. 13, includes an ellipsoidal tip 101 having a flat end surface 102 and being sized for cooperative engagement within ellipsoidal bore 89 of insert 80. The tip 101 is unitary with a frustoconical portion 103, which is in turn unitary with a cylindrical shank 104 having formed in the outer surface thereof an annular groove 105 sized to receive the inner periphery of canted coil spring 90. The groove 105 has angled frustoconical side walls 106, to facilitate sliding the coil spring 90 into (or out of) the recess groove 105 during removal and installation of bit 100, and against circular groove 88 of insert 80. The end of bit 100 opposite ellipsoidal tip 101 is a blade tip and can be of any known type and size, as is well-known in the art.

The balls 50, 51 and springs 52, 53, 54 are preferably stainless steel. The canted coil spring 90 is also stainless steel, of type produced by BAL Seal, Inc., part number 101MB-(MR)-(0.082/0.085)-316-SOW-2. In the constructional embodiment, all other components are preferably made out of aluminum, though an injection molded plastic or stainless steel material may be used instead.

Figure 14:
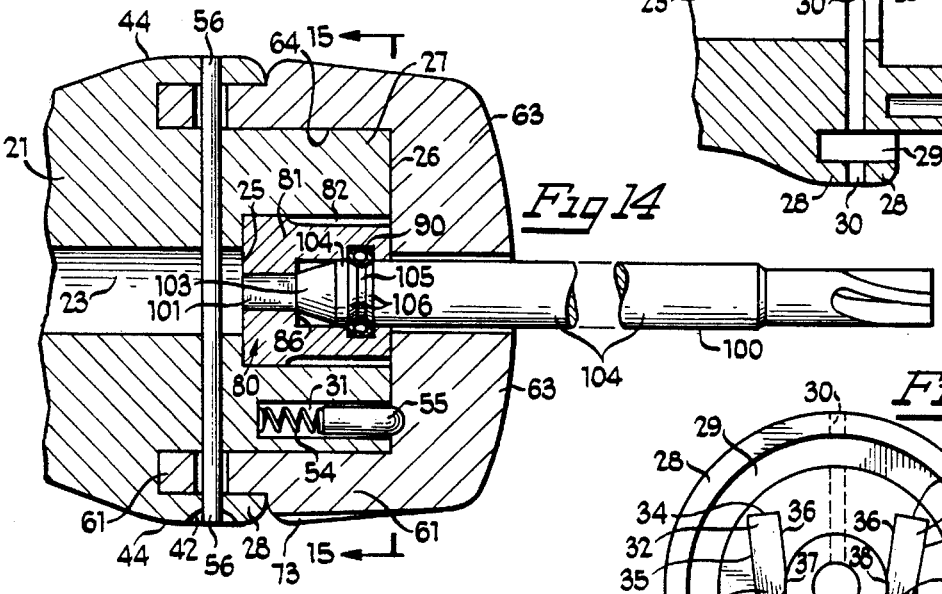
FIG. 14 is an enlarged, fragmentary sectional view of the ratcheting mechanism of FIG. 2 shown in the assembled position.

The operation and assembly of screwdriver 10 will now be described in connection with FIGS. 14–16. Canted coil spring 90 is first positioned within recessed circular groove 88 and held in position by the natural resiliency of the spring 90. Scalloped insert 80 is then rotatably fit within counterbore 24 of head portion 22 with end surface 84 thereof engaging lip 25. The length of insert 80 is substantially the same as the depth of counterbore 24 to provide flush end surfaces. Balls 50, 51 and associated springs 52, 53 are then positioned in respective grooves 32 and 33. Once in position, the balls 50, 51 are urged under spring tension against arcuate walls 36' which constitute the respective edges of arcuate-shaped grooves 39 and 40. Balls 50 and 51 are also biased against the circumference of teeth 82 on scalloped insert 80 by springs 52 and 53, respectively.

Resilient spring 54 and detent pin 55 are then positioned within blind ended bore 31. Cap 60 is rotatably fit over head portion 22 with cylindrical wall 61 engaging in the short annular cavity 29. Dowel pin 56 is then press fitted in the bore 30 and through slots 75, 76, the diameter of which is slightly larger than the diameter of dowel pin 56. When the cap 60 is secured in position, the detent pin 55 in blind ended bore 31 communicates with one of the three circular grooves 70, 71, 72 on the surface 67 of the cap 60, corresponding to the three drive conditions or modes.

Figure 15:
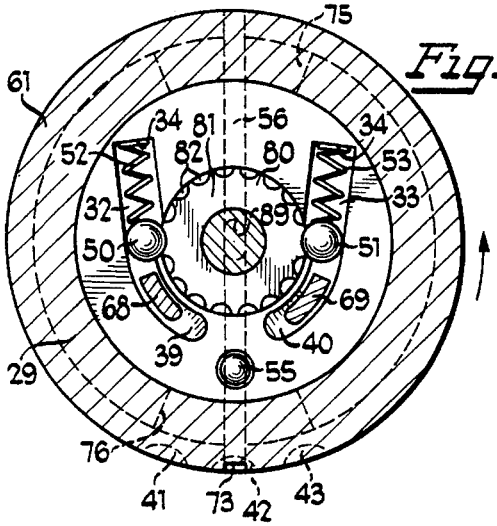
FIG. 15 is a vertical sectional view taken generally along the line 15—15 in FIG. 14 with the screwdriver set in the locked condition.

FIG. 15 shows screwdriver 10 set for operation in the locked or non-ratcheting drive mode. In this mode, the cap 60 is positioned relative to head portion 22 such that the bevelled recess 73 visually aligns with locked position indicating depression 42. During assembly, detent pin 55 will snap into engagement with circular groove 71 when the recess 73 and depression 42 are properly aligned, providing a tactile indication to the user that the screwdriver 10 is in the locked position. In this locked position, arcuate projections 68 and 69 sit, respectively, within arcuate shaped grooves 39, 40 making no contact with associated balls 50, 51.

Figure 16:
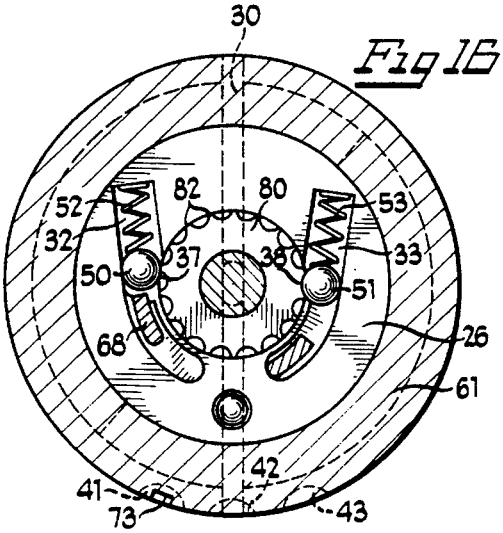
FIG. 16 is a view similar to FIG. 15, but with the ratcheting mechanism in condition for ratcheting in the tightening direction.

Alternatively, when the recess 73 on cap 60 is instead visually aligned with reverse position indicating depression 41, as shown in the view of FIG. 16, detent pin 55 will engage circular groove 70 to provide a tactile indication that the screwdriver 10 is in the reverse ratchet mode. Similarly, when recess 73 is visually aligned with forward position indicating depression 43, detent pin will engage circular groove 72 (not shown) to provide a tactile indication that the screwdriver is set for operation in the forward ratchet mode.

With the cap 60 secured, the screwdriver bit 100 is slidably received through bore 65 of cap 60 by scalloped insert 80, for rotation therewith, and secured tightly therein by the mating engagement of the ellipsoidal tip 101 of bit 100 with the ellipsoidal bore 89 of insert 80. In moving to this position, canted coil spring 90 yields to allow the bit 100 to be received therethrough, snapping into the recessed groove 105 of bit 100 in the mounted position to inhibit bit movement in the axial direction. A great enough pulling force imparted on the bit 100 will, however, disengage the coil spring 90 from recessed groove 105 on bit 100 to allow the user to remove the bit 100 and optionally install a new bit 100 with a different blade tip.

When bit 100 is finally inserted, the assembled screwdriver 10 is ready for use. When screwdriver 10 is in the locked condition, a torque applied on the handle 20 is imparted to the bit 100 regardless of the direction of handle rotation. The reason for this is best explained with reference to FIG. 15, showing balls 50 and 51 biased on opposite sides into engagement with the periphery of the insert 80. Consequently, when the handle is rotated in one direction, for example the clockwise or forward direction as shown by the direction of the arrow, the teeth 82 engaging ball 50 will attempt to displace the ball from its respective position against arcuate wall 36'. In so doing, the teeth 82 and ball 50 will become wedged relative to one another. Similarly, when the handle is rotated in the reverse or counterclockwise direction, ball 51 will become wedged against its respective arcuate wall 36'. Hence, a rotation force on the handle 20 is imparted to the bit 100 by way of the wedging action of balls 50 and 51 on the scalloped insert 80. In the locked condition, therefore, the screwdriver functions like a non-ratcheting screwdriver.

The forward ratchet drive mode is selected by rotating cap 60 clockwise relative to handle 20, bringing beveled recess 73 into alignment with reverse position indicating depression 41 and causing detent pin 55 to engage circular groove 72. When cap 60 is set to the forward ratchet drive condition in relation to the head portion 22 on handle 20, as is shown in FIG. 16, the projection 68 on the inner surface 67 of cap 60 pushes its associated ball 50, against the action of its associated spring 52, out of the way so that it no longer engages the scalloped periphery of insert 80. The other ball 51 is unaffected by projection 69 which makes no contact therewith. Consequently, when handle 20 is rotated in the clockwise direction, ball 51 will be pushed by the scalloped periphery of insert 80 against its associated spring 53, causing handle 20 to ratchet in the forward direction in relation to insert 80. However, when handle 20 is rotated in the opposite or reverse direction, though ball 50 is disengaged from insert 80, ball 51 will wedge between insert 80 and handle 20, causing bit 100 to rotate in the direction in which handle 20 is turned.

When the cap 60 is rotated for positioning in reverse ratchet drive mode (not shown in the drawings), the opposite result of that described above in connection with the forward ratchet drive mode is achieved. Namely, the opposite ball 51 is moved out of the way by projection 69 and the ball 50 will instead ratchet in one direction while causing rotation of handle 20 in the opposite (clockwise) direction. A user selects the forward-lock (reverse ratchet) mode by rotating the cap 60 counterclockwise in relation to handle 20, bringing beveled recess 73 into alignment with forward position indicating depression 43 and causing detent pin 55 to engage circular groove 70. As previously explained, the snap-fit engagement of pin 55 in a corresponding one of the circular grooves 70, 71, 72 during mode selection provides a tactile indication that the cap is adequately secured for the selected rotation mode.

The forward and reverse ratchet mode set by rotating cap 60 in the appropriate direction relative to the handle 20, permit use of the screwdriver 10 as a ratcheting screwdriver, facilitating use of the screwdriver 10 for removing fasteners in one direction with ratcheting in the opposite direction, or for tightening fasteners with ratcheting in the non-tightening direction. When the cap 60 is in the center or locked position in relation to the handle 20, neither ball 50, 51 is moved away from the scalloped periphery of insert 80 and, therefore, the screwdriver does not ratchet in either direction.

In its assembled form, screwdriver 10 is approximately five inches in length end to end. The diameter of cylindrical shank 104 of bit 100 is intended to be very small to facilitate use of the screwdriver in very tight, hard-to-reach places where standard size screwdrivers are inappropriate. More specifically, in the preferred embodiment, cylindrical shank 104 may be less than 0.1 inch in diameter, making possible use of this tool for prosthodontic applications.

Furthermore, the unique geometry and size of the screwdriver 10 permits a user to change the drive mode using only the fingers of the hand in which the tool is held.

Figure 17:
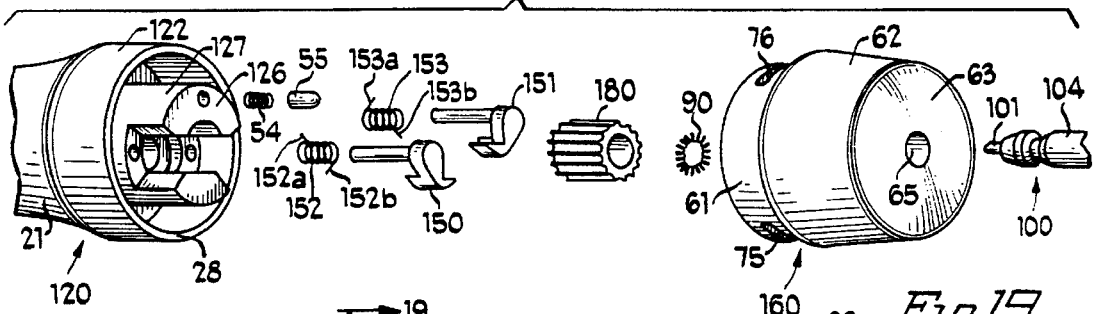
FIG. 17 is an exploded, perspective view of a ratcheting mechanism in the screwdriver of FIG. 1, constructed in accordance with a second preferred embodiment of the invention.

Referring now to FIG. 17, there is illustrated a screwdriver 110, which is externally the same as the screwdriver 10 shown in perspective view in FIG. 1, but including an internal construction in accordance with a second embodiment of the present invention.

Screwdriver 110 consists of a rotatable handle 120 which includes a handle portion 21, and a head portion 122, a left-handed pawl 150, a right-handed pawl 151, torsion springs 152, 153, a resilient spring 54, a detent pin 55, a dowel pin 56, a direction shifting cap 160, a scalloped insert 180, a canted coil spring 90, and a screwdriver bit 100. For convenience and ease of understanding, like components as those described in the first embodiment of the present invention are generally designated by the same reference numeral. Each of torsion springs 152, 153 includes a pair of legs **152*a*, 152*b* and 153*a*, 153*b***, respectively.

Figure 18:
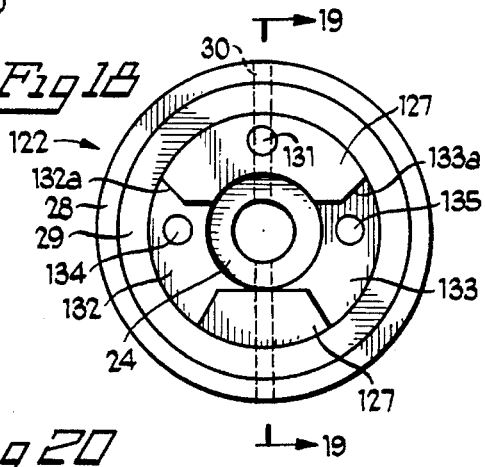
FIG. 18 is an end elevational view of the head portion of the rotatable handle of the ratcheting mechanism of FIG. 17 viewed from the right-hand end thereof.
Figure 19:
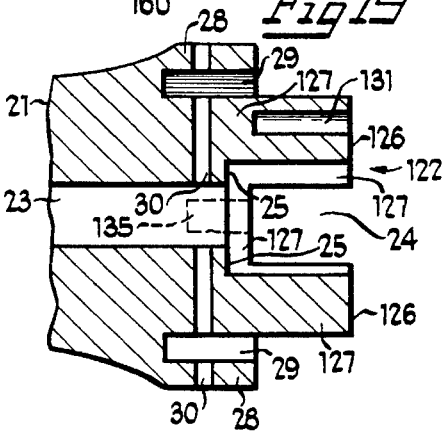
FIG. 19 is a vertical sectional view taken generally along the line 19—19 in FIG. 18.
Figure 20:
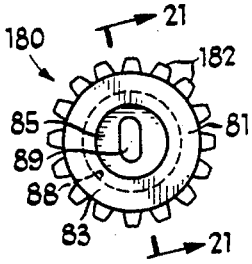
FIG. 20 is an enlarged, end elevational view of the right-hand end of the scalloped insert shown in FIG. 17.
Figure 21:
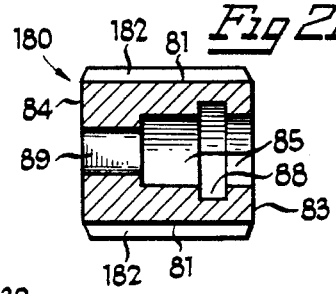
FIG. 21 is a sectional view taken generally along the line 21—21 in FIG. 20.

Head portion 122, shown more clearly in FIGS. 18 and 19, includes an axial bore 23 having an enlarged counterbore 124 at its outer end. Counterbore 124 extends axially from inner end surface 25 to an outer end surface 126 of head portion 122 and defines a first cylindrical wall 127 from which two congruent arcuate portions have been removed to form polygonal-shaped left and right pawl receptacles 132, 133 communicating with the counterbore 124. Left and right receptacle surfaces **132*a*, 133*a* respectively define one side of receptacles 132, 133. Further included are blind ended bores 134, 135 formed respectively in end surface areas of pawl receptacles 132, 133. A second concentric cylindrical wall 28, a short annular cavity 29, and a small diametrical bore 30 are provided in head portion 122 in the same manner and position as in the first embodiment. A blind ended bore 131 (corresponding to bore 31 in the first embodiment, but positioned differently) is provided for receiving resilient spring 54 and detent pin 55**.

Figure 30:
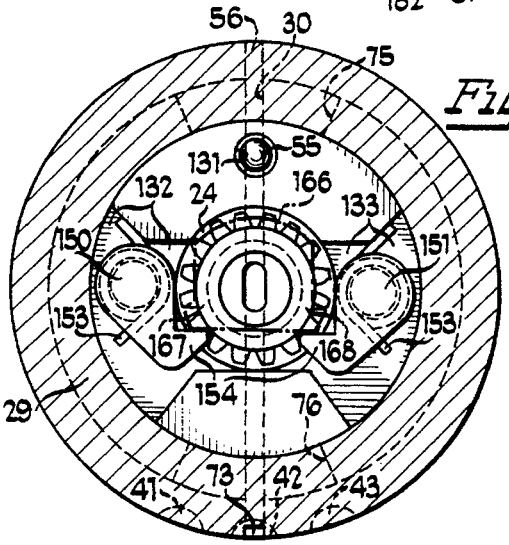
FIG. 30 is a vertical sectional view taken generally along the line 30—30 in FIG. 29 with the screwdriver set in the locked condition.
Figure 29:
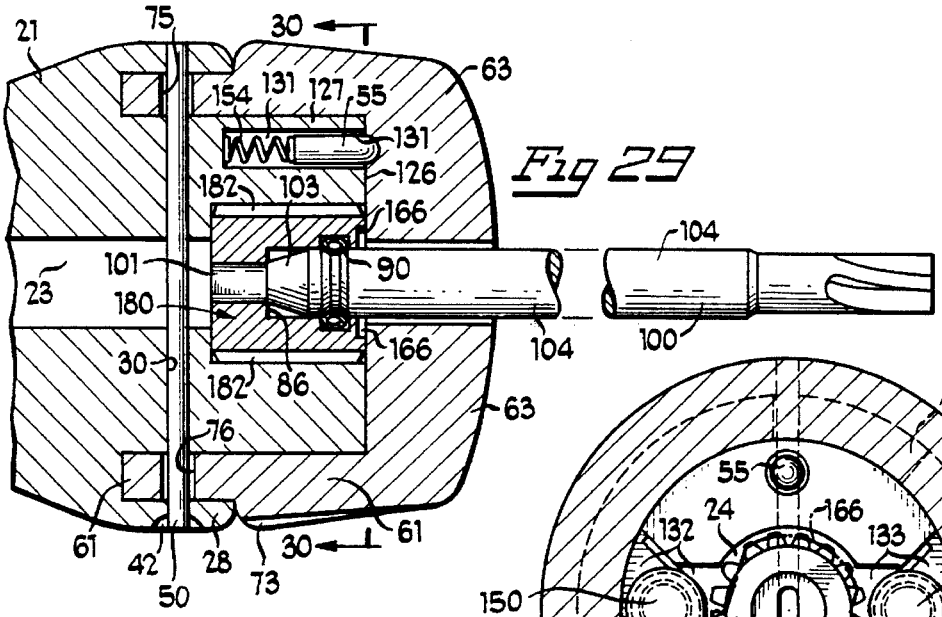
FIG. 29 is an enlarged, fragmentary, sectional view of the ratcheting mechanism of FIG. 17 shown in the assembled condition.
Figure 31:
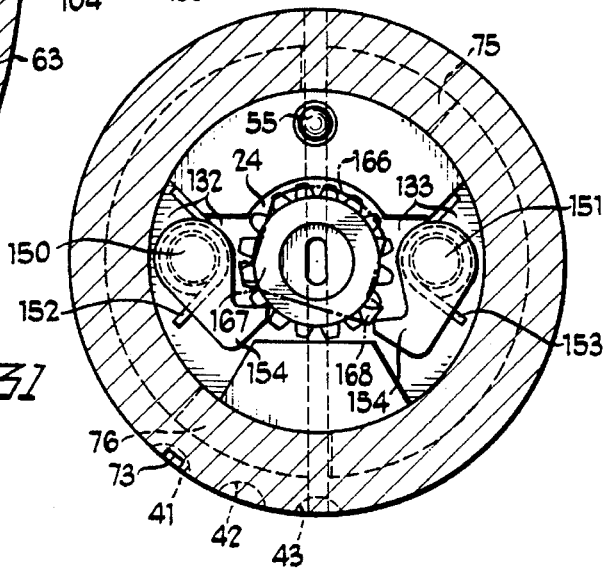
FIG. 31 is a view similar to FIG. 30, but with the ratcheting mechanism in condition for ratcheting in the tightening direction.

The scalloped insert 180 is rotatably fit within counterbore 124 as shown in FIGS. 29–31 and is substantially identical to the scalloped insert 80 of the first embodiment, with the exception that the teeth 182 have a more angled surface and extend the entire axial length of the insert 180.

Left-handed pawl 150 and right-handed pawl 151 are shown in FIGS. 22, 23 and 24, 25, respectively and are formed as mirror images of each other. Pawls 150, 151, which include respective tab portions 154, having an inclined surface 155, and a main body portion 156, are dimensioned to be received within associated pawl receptacles 132 and 133 of head portion 122. From main body portion 156 extends a cylindrical guide pin 157 which is sized to fit within its associated blind ended bore 134, 135 on the associated surface of pawl receptacles 132, 133. Guide pin 157 consists of a torsion spring-receiving portion 158, around which an associated one of torsion springs 152, 153 is wrapped, and a bore engagement portion 159 which is rotatably fit into the associated one of bores 134, 135.

Figure 26:
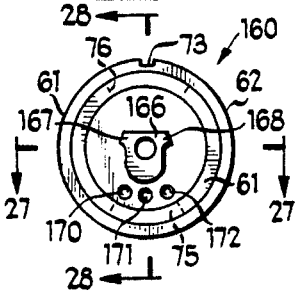
FIG. 26 is a reduced, end elevational view of the left-hand end of the cap shown in FIG. 17.
Figure 27:
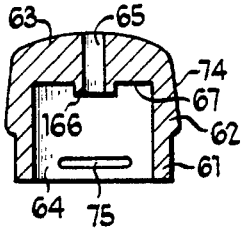
FIG. 27 is a sectional view taken generally along the line 27—27 in FIG. 26.
Figure 28:
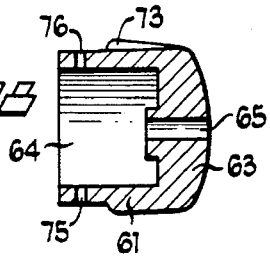
FIG. 28 is a sectional view taken generally along the line 28—28 in FIG. 26.
Figure 22:
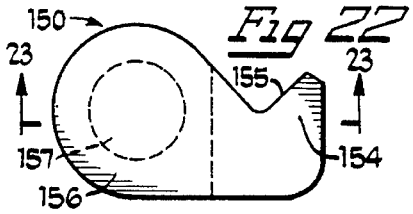
FIG. 22 is an enlarged, end elevational view of the right-hand end of the left-hand pawl shown in FIG. 17.
Figure 24:
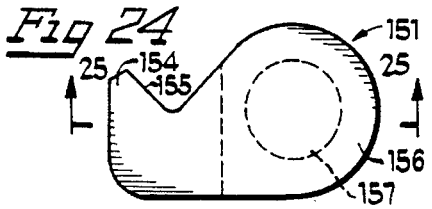
FIG. 24 is an enlarged, end elevational view of the right-hand end of the right-hand pawl shown in FIG. 17.
Figure 23:
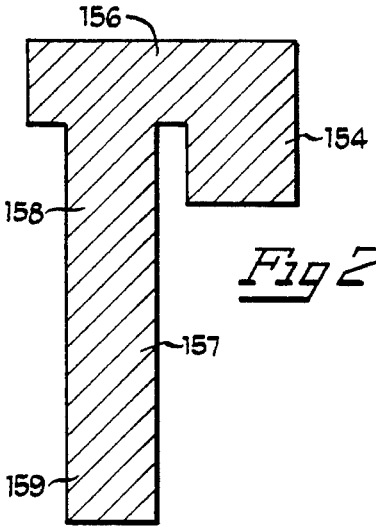
FIG. 23 is a sectional view taken generally along line 23—23 in FIG. 22.
Figure 25:
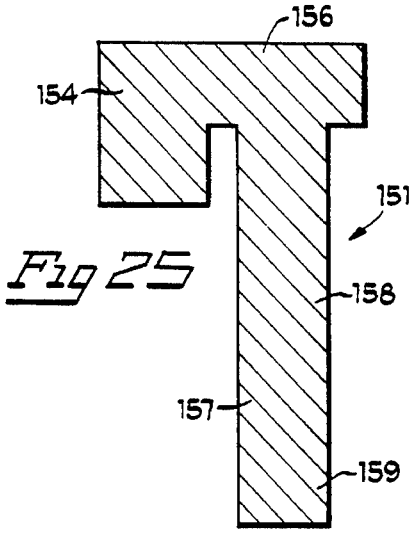
FIG. 25 is a sectional view taken generally along line 25—25 in FIG. 24.

Direction shifting cap 160, shown in FIGS. 26–28, is similar in function and design to cap 60 of the first embodiment, differing only as follows. Projections 68 and 69 have been replaced by a single projection 166 extending inwardly from surface 67 and including tab portions 167 and 168 which make contact with associated ones of tab portion 155 on left and right-handed pawls 150, 151 when the cap 160 is rotatably fit into position with head portion 122. Circular grooves 170, 171, and 172 are also provided (corresponding to grooves 70, 71, and 72) to engage detent pin 55 therein during mode setting, as in the first embodiment.

The assembly and operation of screwdriver 110 will now be described with reference to FIGS. 29 and 30. As in the first embodiment, canted coil spring 90 is positioned within circular groove 88 of insert 180 to facilitate snap-fit engagement of an interchangeable bit 100 into the insert 180. The insert 180 is then rotatably fit in counterbore 24 of head portion 122 in similar manner as in the first embodiment. Each of torsion springs 152, 153 is placed around the torsion spring-receiving portion 158 of associated pawl 151, 152 The pawls 151, 152 are then placed into their associated pawl receptacles 132, 133 on the head portion 122 and aligned therein by the engagement of pawl guide pins 157 within their associated bores 134, 135. With the pawls 150, 151 engaged, legs **152*a* and 153*a* associated with torsion springs 152, 153, respectively, are biased against associated receptacle surfaces 132*a* and 133*a*. Similarly, legs 152*b* and 153*b* of torsion springs 152, 153, respectively, are biased against the torsion spring-receiving portion 158 of corresponding pawls 150, 151, to urge the associated tab portions 154 of pawls 150, 151 against the outer scalloped periphery of insert 180**.

Once the pawls 150, 151 are in position, the cap 160 is rotatably fitted thereover to act as a cover as well as to provide mode shifting, in a manner similar to the first embodiment. More particularly, in the locked drive condition shown in FIG. 30, tab portions 167 and 168 of cap projection 166 are positioned to allow both tab portions 154 of associated pawls 150, 151 to engage the teeth of insert 180 to restrain ratcheting of the handle 120 relative to the insert 180. In this position, screwdriver 110 functions as a non-ratcheting screwdriver.

By twisting cap 160 counterclockwise relative to the handle 120 until recess 73 on cap 160 aligns with the reverse position indicating depression 41, screwdriver 110 is set to the forward ratchet drive position, shown in FIG. 31. In the forward-ratchet drive position, the projection 166 on the inner surface 67 of cap 160 is rotated just enough to cause tab portion 168 on the projection 166 to push against the tab portion 154 on pawl 151, causing it to be moved out of engagement with the teeth 182 on insert 180. The position of the opposite pawl 150 in relation to the insert 80, however, remains unaffected. Consequently, when the handle 120 is rotated in the forward (tightening) direction, the tooth 182 contacting the inclined surface 155 of pawl 150 pushes the pawl 151 away from the insert 180 causing the handle 120 to ratchet. By contrast, when the handle 120 is rotated in the reverse (loosening) direction, the tooth 182 adjacent to the tooth previously contacting the inclined surface 155 of pawl 150 pushes the underside tab portion 154 of pawl 150 in the direction of the adjacent tooth, causing the pawl 150 to become wedged. Once wedged, the handle 120 and insert 180 rotate together causing the bit 100 to be carried thereby. Thus, in the position of the cap 160 shown in FIG. 31, ratcheting occurs in the tightening direction and torquing (loosening) in the reverse direction.

When the cap 160 is rotated for positioning in reverse ratchet drive mode causing the pawl 150 to be pushed away from the insert 180, the opposite result of that described above in connection with the forward ratchet drive mode is achieved. Namely, ratcheting occurs in the loosening direction and torquing (tightening) in the forward direction.

Pawls 150, 151, torsion springs 152, 153 and coil spring 90 are preferably stainless steel. As in the first embodiment, all other components may be made of aluminum, an injection molded plastic, a stainless steel material or of equivalents thereof.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims When viewed in their proper perspective based on the prior art.

We claim:

1. A ratcheting driver comprising:

a handle having an axial bore and two receptacles;

an insert, having a plurality of teeth, received in said bore;

first and second pawl assemblies respectively received in said receptacles, and resiliently urged into engagement with the teeth on said insert;

a shank coupled to said insert for rotation therewith; and a mode shifting structure carried by said handle and movable between first and second conditions, where in the first condition, said first pawl assembly is held out of engagement with the teeth on said insert for use of said screwdriver in reverse-ratcheting mode, and where in the second condition, said second pawl assembly is held out of engagement with said teeth for use of said screwdriver in forward-ratcheting mode, said insert including a cylindrical interior surface having a first annular recess formed therein and said shank including a second annular recess formed therein, said first and second recesses cooperate to receive therebetween a coiled spring for frictionally retaining said shank in said insert.

2. The ratcheting driver of claim 1, wherein said first and second pawl assemblies each comprise a ball and a compressible spring.

3. The ratcheting driver of claim 2, wherein said mode shifting structure includes means for movably disengaging the balls of an associated one of said first and second pawl assemblies from said teeth on the insert when in the first and second conditions, respectively.

4. The ratcheting driver of claim 1, wherein said first and second pawl assemblies comprise left and right pawls respectively disposed in said receptacles and urged against said teeth on the insert by corresponding torsion springs.

5. The ratcheting driver of claim 1, wherein said driver is a miniature screwdriver for use in prosthodontic medicine.

6. The driver of claim 1, wherein said mode shifting structure is movable to a third condition wherein said first and second pawl assemblies are engaged with the teeth on said insert.

7. A ratchet driver operable in reverse ratcheting and forward ratcheting modes comprising:

a rotatable handle having along an end thereof a substantially cylindrical interior wall defining an annular base surface and an axial bore, said base surface having two substantially arcuate grooves formed therein communicating with said bore;

an insert received in said bore and including longitudinally extending arcuate teeth spaced equiangularly around the outer periphery thereof;

first and second balls disposed respectively in said arcuate grooves and urged against said teeth on said insert by first and second compression springs, respectively;

a shank coupled to said insert for rotation therewith; and a cap, coupled to said rotatable handle, including mode shifting means for selecting the mode of operation of said driver, whereby in each of the reverse and forward ratcheting modes a corresponding one of said balls is urged away from its wedged engagement with said insert, providing ratcheting of said shank in one direction of handle rotation, and rotation of said shank together with said handle in the opposite direction.

8. The ratchet driver of claim 7, wherein said driver is a miniature screwdriver for use in prosthodontic medicine.

9. The ratchet driver of claim 7, wherein said insert includes a cylindrical interior surface having a first annular recess formed thereon and said shank includes a shaft having a second annular recess formed therein, said first and second recesses cooperating to receive therebetween a canted coil spring for frictionally retaining said shank in said insert.

10. The ratchet driver of claim 7, wherein said driver is made sufficiently small to permit a user to change the mode of operation using only the fingers of the hand in which the driver is held.

11. The ratchet driver of claim 7, wherein said shank has a blade end for facilitating tightening and loosening of screws therewith, said driver being approximately five inches in length measured from a tip of said blade end to the distal end of said rotatable handle opposite said blade end, and the thickness of said shank being less than 0.1 inch in diameter.

12. The driver of claim 7, wherein said mode shifting means is operable for selecting a non-ratcheting mode in which said first and second balls are wedged against teeth on said insert to prevent ratcheting of said handle relative to said bit in either direction of rotation.

13. A ratcheting driver handle for a driver having a shank, said handle comprising:

an elongated body having an axis, and an axial recess in one end thereof, a ratchet mechanism disposed in said recess and including a gear and a pawl assembly including at least one pawl engageable with said gear, said ratchet mechanism having a bore for receiving therein the shank of the associated driver, said ratchet mechanism including mounting means for said pawl assembly accommodating movement of said at least one pawl between first and second conditions, said at least one pawl including a first tooth portion engaging said gear in the first condition of said pawl assembly so that said body rotates said gear with said body when the body is rotated in one direction and said body ratchets with respect to said gear when said body is rotated in the opposite direction, said pawl assembly including a second tooth portion engaging said gear in the second condition of said pawl assembly so that said body rotates said gear with said body when said body is rotated in said opposite direction and said body ratchets with respect to said gear when said body is rotated in said one direction, a selector member coupled to said one end of said body and accessible by a user for manual movement with respect to said one end between first and second positions corresponding respectively to said first and second conditions of said pawl assembly, and actuator projection structure on said selector member extending parallel to said axis and positioned and dimensioned for direct engagement with said at least one pawl for movement of said at least one pawl between its first and second conditions in response to movement of said selector member between its first and second positions.

14. The driver handle of claim 13, wherein said pawl assembly includes two pawls respectively engageable with said gear in said first and second conditions.

15. The driver handle of claim 14, wherein said selector member includes two actuator projections respectively engageable with said pawls for movement thereof out of engagement with said gear.

16. The driver handle of claim 13, wherein said pawl assembly includes two pivoting pawls and two torsion springs respectively resiliently urging said pawls into engagement with said gear.

17. The driver handle of claim 16, wherein said projection structure includes portions respectively engageable with said pawls for respectively moving them out of engagement with said gear in said first and second conditions.

18. The driver handle of claim 13, wherein said mounting means includes means for accommodating movement of said at least one pawl to a third condition wherein both of said first and second tooth portions are engaged with said gear.

19. The driver handle of claim 13, and further comprising retaining mechanism for resiliently retaining said selector member in each of its first and second positions.

* * * * *